US008070531B1

(12) United States Patent
Ku et al.

(10) Patent No.: US 8,070,531 B1
(45) Date of Patent: Dec. 6, 2011

(54) KEYSTONE JACK

(75) Inventors: Ying-Ming Ku, Taoyuan (TW); Chun-Chieh Chen, Taoyuan (TW)

(73) Assignee: YFC-BONEAGLE Electric Co., Ltd., Taoyuan (TW)

( * ) Notice: Subject to any disclaimer, the term of this patent is extended or adjusted under 35 U.S.C. 154(b) by 0 days.

(21) Appl. No.: 13/118,692

(22) Filed: May 31, 2011

(51) Int. Cl.
*H01R 13/625* (2006.01)

(52) U.S. Cl. ..... 439/676; 439/941

(58) Field of Classification Search ..... 439/676, 439/941, 942, 393, 395
See application file for complete search history.

(56) References Cited

U.S. PATENT DOCUMENTS 6,267,617 B1 * 7/2001 Nozick ..... 439/417
6,338,655 B1 * 1/2002 Masse et al. ..... 439/638
7,182,649 B2 * 2/2007 Caveney et al. ..... 439/676

* cited by examiner

*Primary Examiner* — Tulsidas C Patel
*Assistant Examiner* — Travis Chambers
(74) *Attorney, Agent, or Firm* — Chun-Ming Shih; HDLS IPR Services

(57) ABSTRACT

A keystone jack (10) includes a cover body (1), a lining body (2), a carrier body (3), a printed circuit board (4), a housing (5), and a flap (6). The cover body (1) includes a space (11). The space (11) includes a cruciform partition with an elongated partition plate (13) perpendicular interlaced a short partition plate (14). The lining body (2) has two edges (21). A connection part (22) is between the two edges (21). A stud (23) and a separation plate (24) are between the connection part (22) and the two edges (21). The stud (23) has a first channel (231). The separation plate (24) has a second channel. When the lining body (2) is installed in the space (11), the elongated partition plate (13) and the short partition plate (14) in the space (11) are through the first channel (231), the second channel (242), and the opening (25) to form a double-cross isolation structure. When the keystone jack (10) is used, the electricity is more stable, and the crosstalk interferences are decreasing, and the impedance is more stable, and the electronic signals are not decayed.

9 Claims, 8 Drawing Sheets

KEYSTONE JACK

BACKGROUND OF THE INVENTION

1. Field of the Invention

The present invention relates to a jack and in particular to a keystone jack with a double-cross isolation structure to avoid the crosstalk phenomenon.

2. Description of Prior Art

When the electronic signals are transmitted along the layouts of the printed circuit board, the electromagnetic waves of the electronic signals are transmitted from one side of the integrated circuit to another side of the integrated circuit along the layouts of the printed circuit board as well, so the crosstalk happens. Due to the electromagnetic induction, the voltages and the currents are varied transiently by the electromagnetic waves in the transmission process.

The electromagnetic waves are induced by the electric fields and the magnetic fields with time variation. In fact, the electric fields and the magnetic fields exist not only in each kind of layouts in the printed circuit board. The energy of a plenty of electromagnetic waves exists outside the layouts. So when the electronic signals are transmitted along the lead wire and there are other wiring lines nearby, other wiring lines will be impacted by the electric fields and the magnetic fields of the electronic signals.

According to the Maxwell equation, the electric fields and the magnetic fields will induce the voltages and the currents in the lead wire nearby, so the electric fields and the magnetic fields induced from the transmission process of the electronic signals will cause the electronic signal interferences. This phenomenon is called the crosstalk phenomenon.

Beside the crosstalk phenomenon in the printed circuit board mentioned above, the crosstalk phenomenon exists in the conventional keystone jacks or other connectors as well. The distance of the pins of the puncturing terminals is short because the volume of the keystone jack is small. The core wires are closed because the distance of the pins of the puncturing terminals is short, so that the electricity is not stable when the electronic signals are transmitted. The electromagnetic waves induced by the puncturing terminals will impact the puncturing terminals nearby, so that the impedance characteristics are not stable and the transmission signals are decayed.

SUMMARY OF THE INVENTION

Therefore, the main object of the present invention is to solve the crosstalk phenomenon in the conventional keystone jacks. After a double-cross isolation structure is installed in the puncturing terminals in the keystone jack, the electricity is more stable when the keystone jack is used. The crosstalk interferences are decreasing, and the impedance characteristics are more stable, and the transmission signals are not decayed.

In order to achieve the object mentioned above, the present invention provides a keystone jack including a cover body, a lining body, a carrier body, a printed circuit board, a housing, and a flap.

The cover body includes a space. A joining part in barb shape is on each of the four corners of the space. The space includes a bottom surface. An elongated partition plate is on the bottom surface. The elongated partition plate perpendicular interlaces a short partition plate. The short partition plate includes a bottom part. A distance is formed between the bottom part and the bottom surface. Besides, a first neck part is extended from a side of the cover body. The first neck part includes a groove.

The lining body is installed in the space. The lining body has two symmetric edges. The two edges have a plurality of symmetric slots. The slot has a lateral insertion port. A connection part is between the two edges. The connection part has a stud being in U-type and having a first channel. Besides, a separation plate is between the two edges. The separation plate includes a convex wall having a second channel opposite to the first channel. An opening is formed between the separation plate and the connection part.

The carrier body includes a first bearing part, a second bearing part, and a metal spring. The first bearing part includes a plurality of puncturing terminals inserting opposite to the slots. One side of the puncturing terminal is a welding part through the first bearing part. The second bearing part includes a plurality of conducting pins. One side of the conducting pin is a pin part.

The printed circuit board includes a plurality of holes. After the welding parts and the pin parts are through the holes of the printed circuit board, the welding parts and the pin parts are electrically connected to the printed circuit board.

The housing includes a fore end part and a rear end part. The fore end part and the rear end part have an assembling space. The fore end part includes a port. The rear end part includes a joint part. Besides, a coupling part is in the bottom of the housing.

The flap includes a cover splicing to the rear end part. One side of the cover is a second neck part opposite to the first neck part of the cover body. An axial part is in the other side of the cover. The axial part is pivotally connected to a resilient body. The resilient body is through the coupling part.

Moreover, when the lining body is installed in the space, the elongated partition plate and the short partition plate of the space are through the first channel, the second channel, and the opening to form a double-cross isolation structure, so that the electricity is more stable when the keystone jack is used. The crosstalk interference is decreasing, and the impedance characteristics are more stable, and the transmission signals are not decayed.

DETAILED DESCRIPTION OF THE INVENTION

Figure 1:
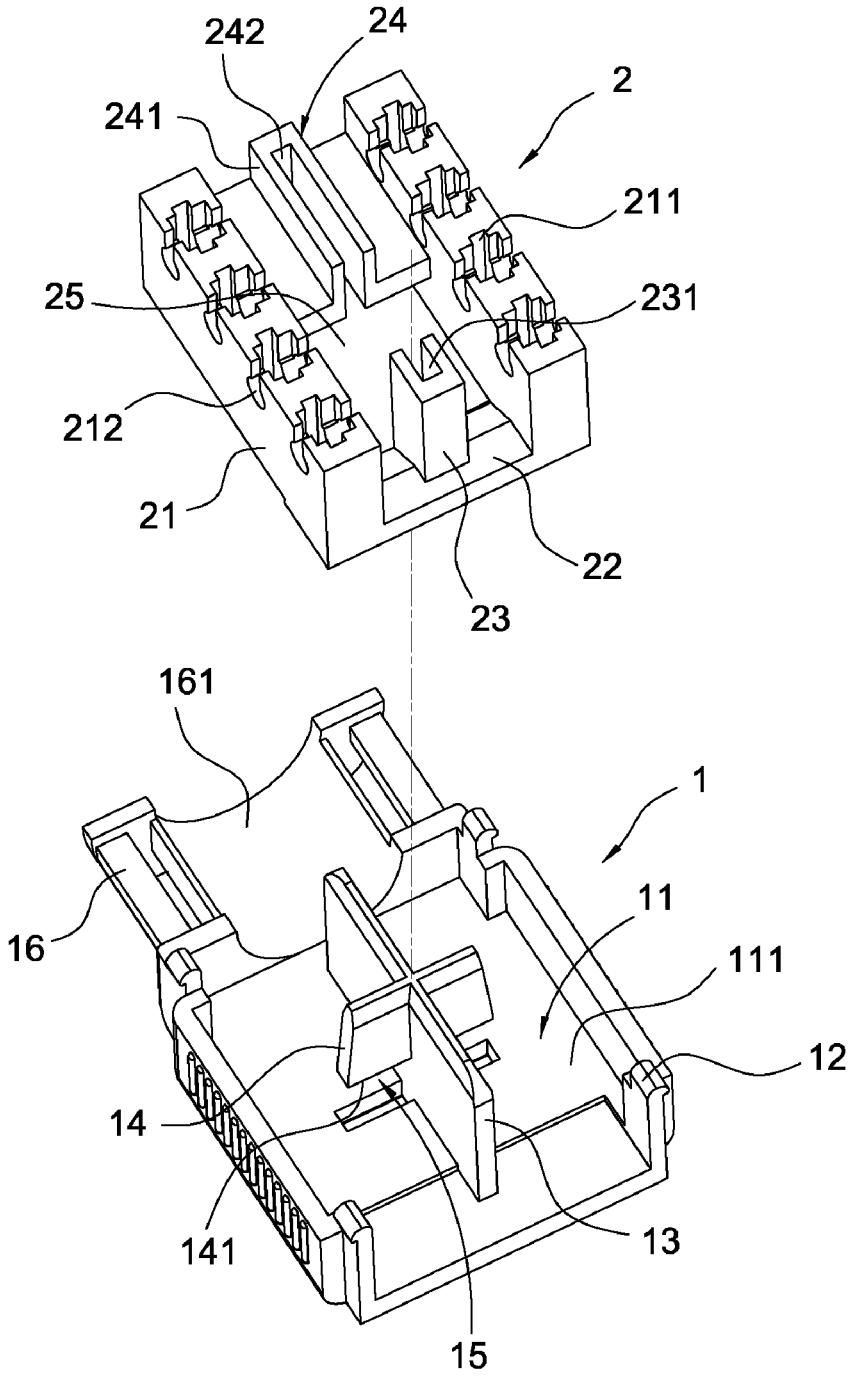
FIG. 1 shows a partial exploded view of the keystone jack of the present invention.
Figure 2:
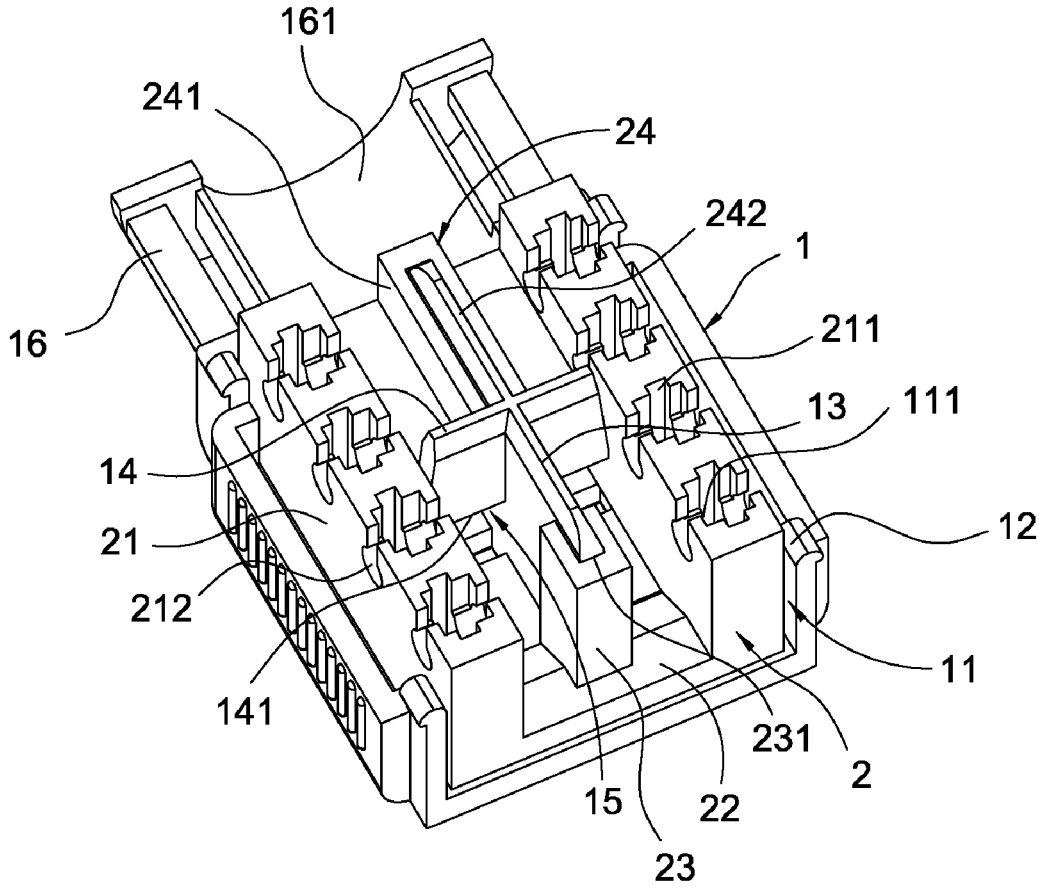
FIG. 2 shows a partial perspective view of the keystone jack of the present invention.

Regarding the technology and the detailed description of the present invention, now describe with diagrams as below:

FIG. 1 shows a partial exploded view of the keystone jack of the present invention. FIG. 2 shows a partial perspective view of the keystone jack of the present invention. As shown in the FIG. 1 and the FIG. 2, the keystone jack of the present invention at least includes a cover body 1 and a lining body 2.

The cover body 1 includes a space 11. A joining part 12 in barb shape is on each of the four corners of the space 11. The space 11 includes a bottom surface 111. An elongated partition plate 13 is on the bottom surface 111. The elongated partition plate 13 perpendicularly interlaces a short partition plate 14. The short partition plate 14 includes a bottom part 141. A distance 15 is formed between the bottom part 141 and the bottom surface 111. Besides, a first neck part 16 is extended from a side of the cover body 1. The first neck part 16 includes a groove 161. The groove 161 is used to connect the cable line (not shown in the Fig.).

The lining body 2 is installed in the space 11. The lining body 2 has two symmetric edges 21. The two edges 21 have a plurality of symmetric slots 211. The slot 211 has a lateral insertion port 212. A connection part 22 is between the two edges 21. The connection part 22 has a stud 23 being in U-type and having a first channel 231.

Besides, a separation plate 24 is provided between the two edges 21. The separation plate 24 divides the height (or the thickness) of the two edges 21 into an upper layer space and a lower layer space. The separation plate 24 includes a convex wall 241 having a second channel 242 opposite to the first channel 231. Besides, an opening 25 is formed between the separation plate 24 and the connection part 22. The core wires of the cable line are through the opening 25. When the lining body 2 is installed in the space 11, the elongated partition plate 13 and the short partition plate 14 of the space 11 are through the first channel 231, the second channel 242, and the opening 25.

Figure 3:
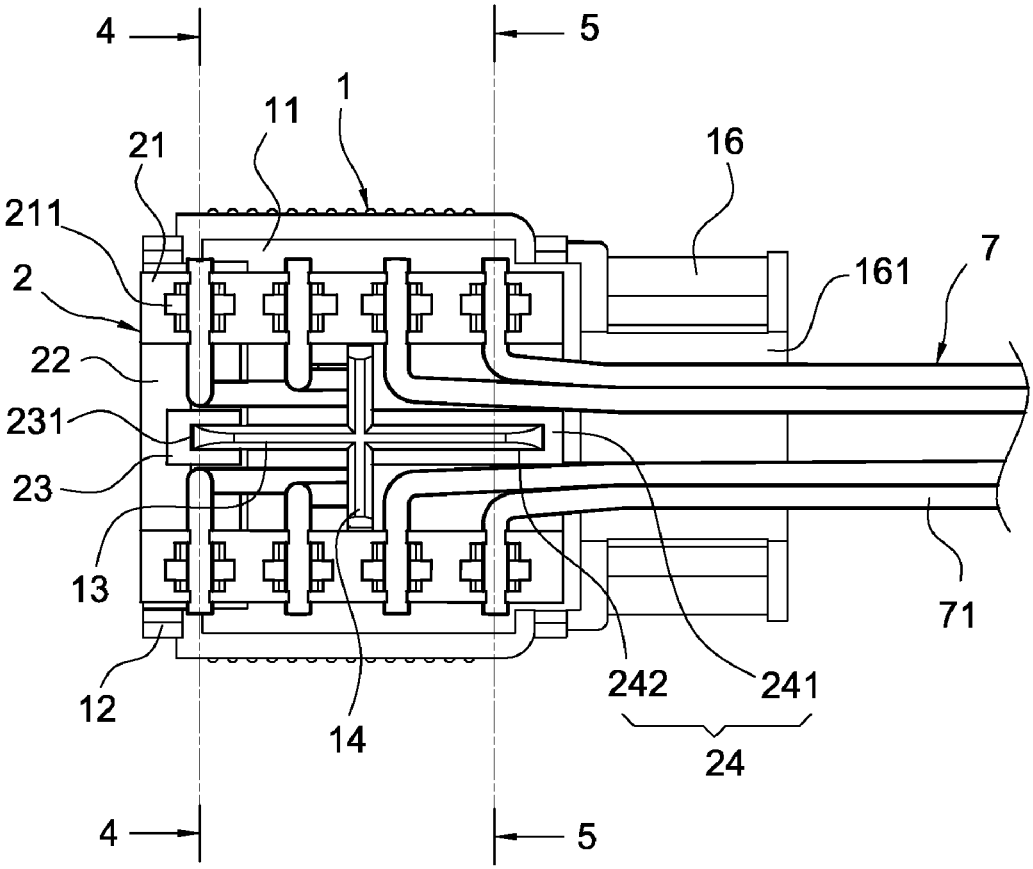
FIG. 3 shows a top view of the combination of the cover body, the lining body, and the cable line of the present invention.
Figure 4:
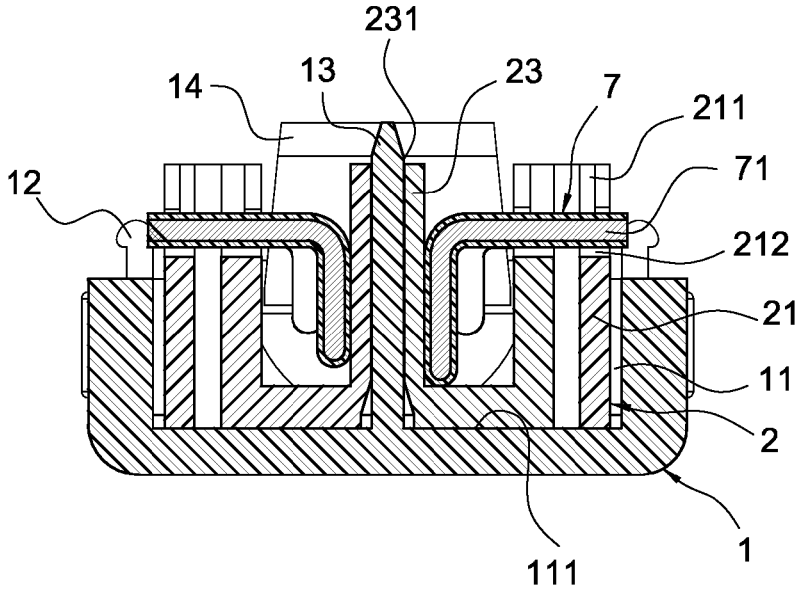
FIG. 4 shows a sectional view along line 4-4 in the FIG. 3.
Figure 5:
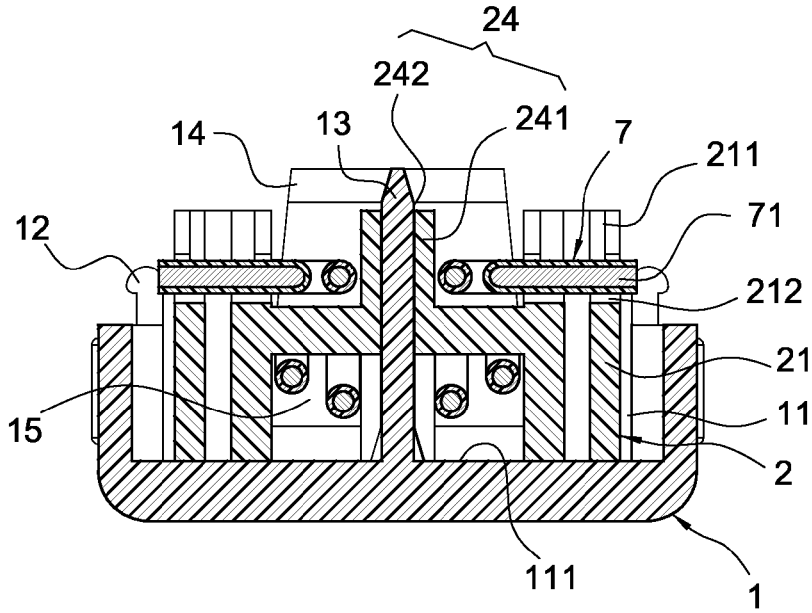
FIG. 5 shows a sectional view along the line 5-5 in the FIG. 3.

FIG. 3 shows a top view of the combination of the cover body, the lining body, and the cable line of the present invention. FIG. 4 shows a sectional view along line 4-4 in the FIG. 3. FIG. 5 shows a sectional view along the line 5-5 in the FIG. 3.

As shown in the FIG. 3, the FIG. 4 and the FIG. 5, after the lining body 2 is installed in the cover body 1, the separation plate 24 divides the space 11 into the upper layer space and the lower layer space. After the wrap of a cable line 7 is removed, the cable line 7 shows a plurality of core wires 71. After a part of the core wires 71 are inserted through the lower layer space of the separation plate 24 and are inserted through the opening 25, the core wires 71 are inserted in the insertion ports 212, so that the core wires 71 are in the slots 211. After the other core wires 71 are inserted through the upper layer space of the separation plate 24, the core wires 71 are inserted in the other insertion ports 212, so that the other core wires 71 are in the other slots 211.

Figure 6:
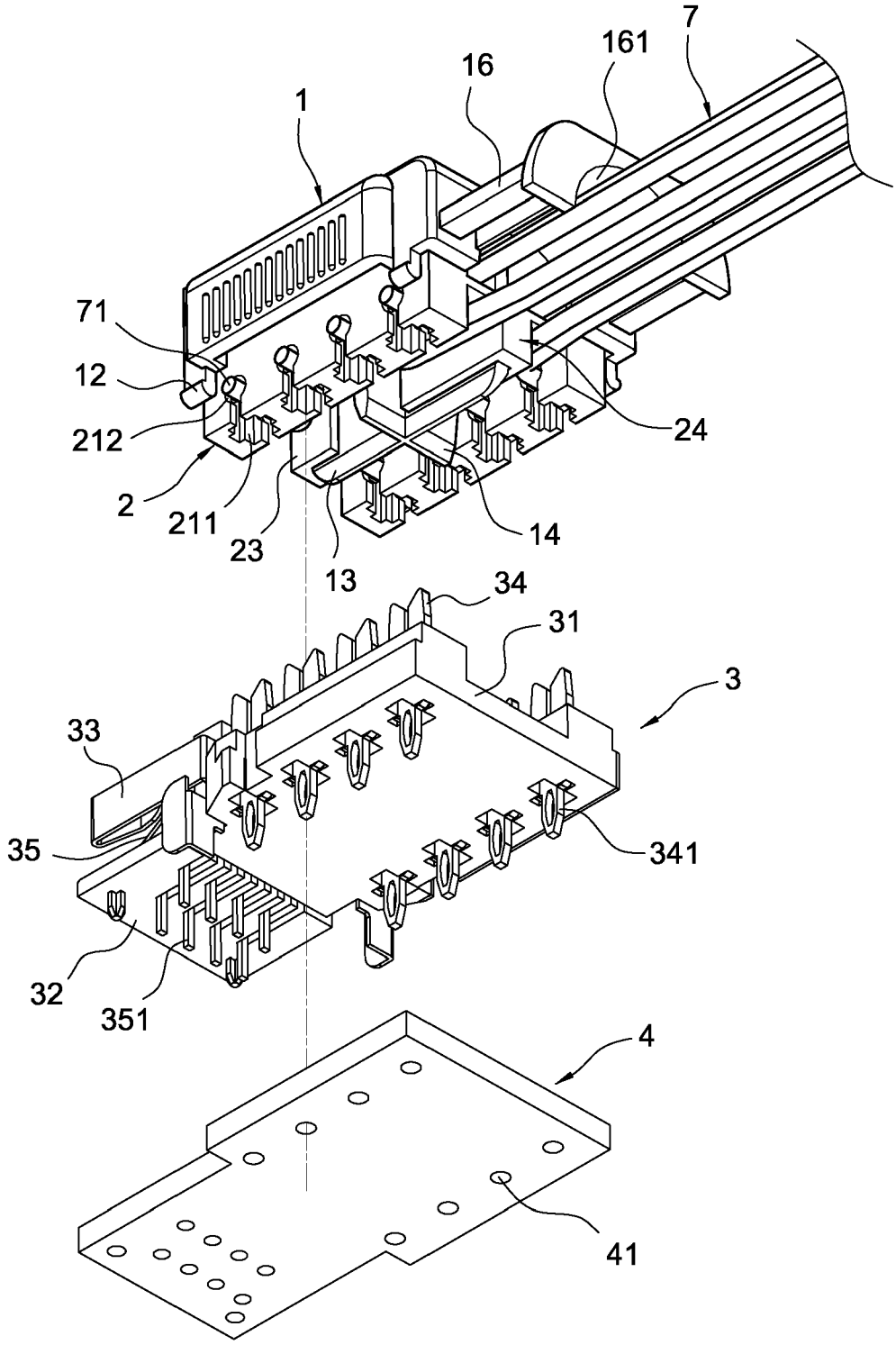
FIG. 6 shows an exploded view of the combination of the cover body, the lining body, and the cable line, with the carrier body, and the printed circuit board of the present invention.

FIG. 6 shows an exploded view of the combination of the cover body, the lining body, and the cable line, with the carrier body, and the printed circuit board of the present invention. As shown in the FIG. 6, after the cover body 1, the lining body 2, and the cable line 7 are assembled, the combination of the cover body 1, the lining body 2, and the cable line 7 will be assembled with a carrier body 3 and a printed circuit board 4.

The carrier body 3 includes a first bearing part 31, a second bearing part 32, and a metal spring 33. The first bearing part 31 includes a plurality of puncturing terminals 34 inserting opposite to the slots 211. One side of the puncturing terminal 34 is a welding part 341 through the first bearing part 31. The second bearing part 32 includes a plurality of conducting pins 35. One side of the conducting pin 35 is a pin part 351. After the welding parts 341 and the pin parts 351 are through the holes 41 of the printed circuit board 4, the welding parts 341 and the pin parts 351 are electrically connected to the printed circuit board 4.

After the carrier body 3 is electrically assembled with the printed circuit board 4, and after the puncturing terminals 34 of the first bearing part 31 are inserted in the slots 211, and after the skins of the core wires 71 are scratched by the puncturing terminals 34, the puncturing terminals 34 are electrically connected to the core wires 71.

Figure 7:
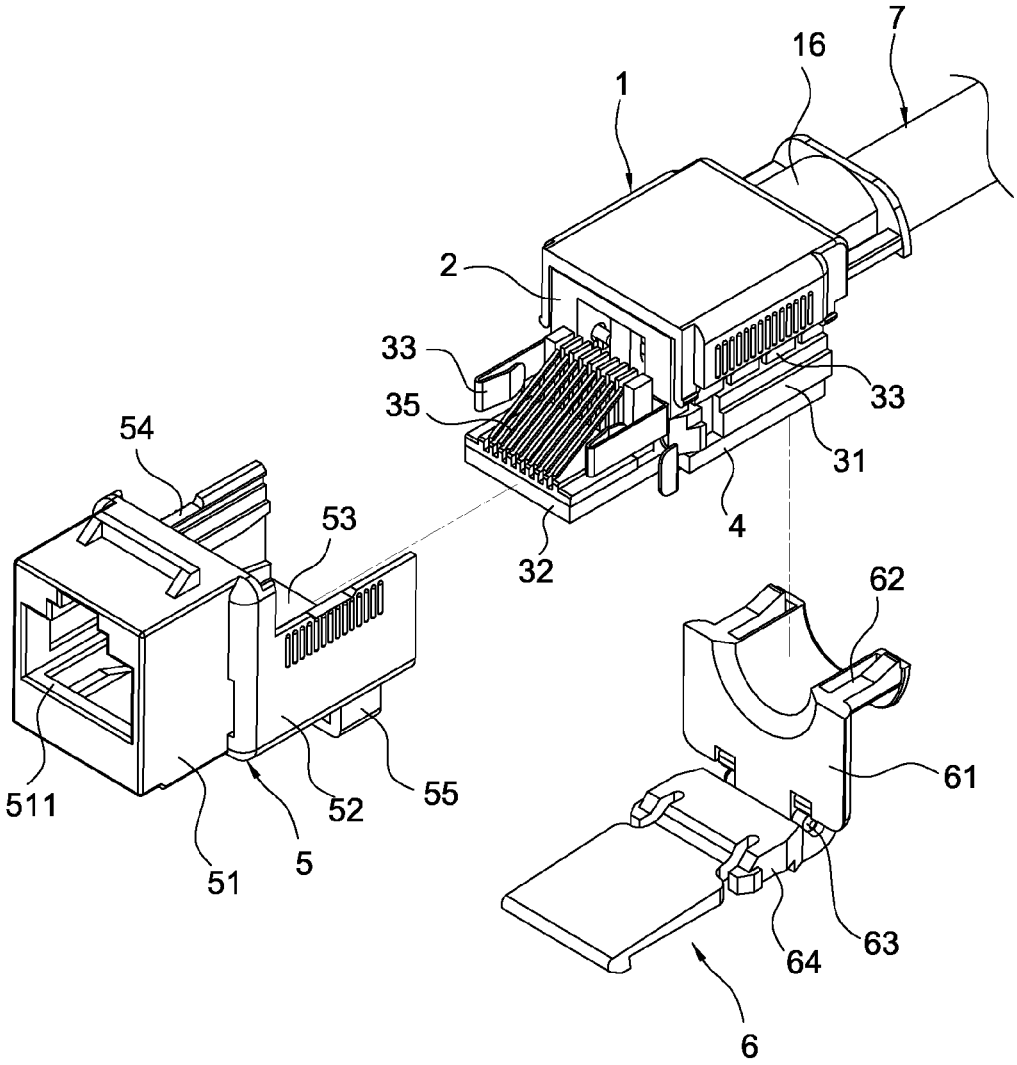
FIG. 7 shows an exploded view of the combination of the cover body, the lining body, the cable line, the carrier body, and the printed circuit board, with the housing, and the flap of the present invention.
Figure 8:
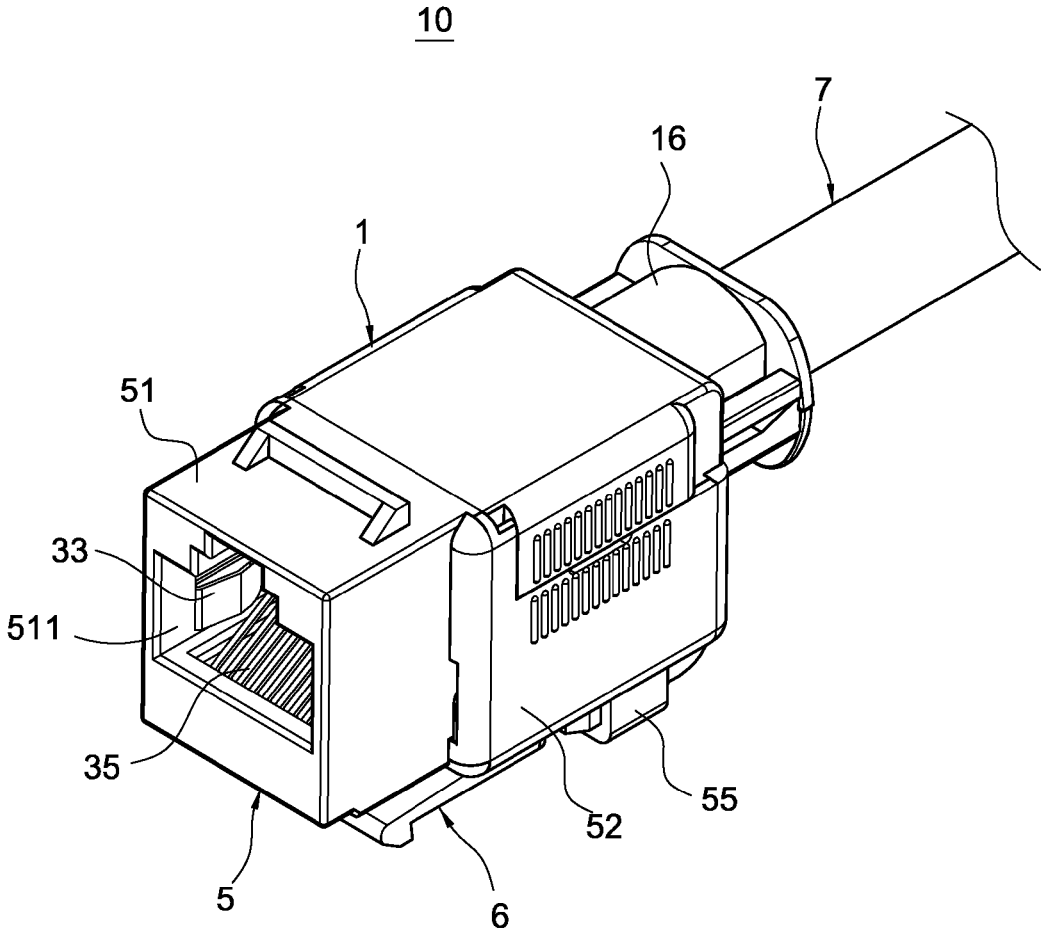
FIG. 8 shows a perspective view of the combination of the cover body, the lining body, the cable line, the carrier body, the printed circuit board, the housing, and the flap of the present invention.

FIG. 7 shows an exploded view of the combination of the cover body, the lining body, the cable line, the carrier body, and the printed circuit board, with the housing, and the flap of the present invention. FIG. 8 shows a perspective view of the combination of the cover body, the lining body, the cable line, the carrier body, the printed circuit board, the housing, and the flap of the present invention. As shown in the FIG. 7 and the FIG. 8, the combination of the cover body 1, the lining body 2, the cable line 7, the carrier body 3, and the printed circuit board 4 are assembled with a housing 5. The housing 5 includes a fore end part 51 and a rear end part 52. The fore end part 51 and the rear end part 52 have an assembling space 53. The fore end part 51 includes a port 511. The rear end part 52 includes a joint part 54.

When the combination of the cover body 1, the lining body 2, the cable line 7, the carrier body 3, and the printed circuit board 4 is installed in the assembling space 53, the first bearing part 31, the lining body 2, and the printed circuit board 4 are in the rear end part 52, while the cover body 1 is on the joint part 54 of the rear end part 52. The second bearing part 32 is in the fore end part 51 so that the conducting pins 35 are opposite to the port 511. Besides, a coupling part 55 is in the bottom of the housing 5.

Moreover, the housing 5 will be assembled with a flap 6. The flap 6 includes a cover 61 splicing to the rear end part 52. One side of the cover 61 is a second neck part 62 opposite to the first neck part 16 of the cover body 1. An axial part 63 is in the other side of the cover 61. The axial part 63 is pivotally connected to a resilient body 64. The resilient body 64 is through the coupling part 55 in the bottom of the housing 5 to accomplish the assembly of a keystone jack 10.

Figure 9:
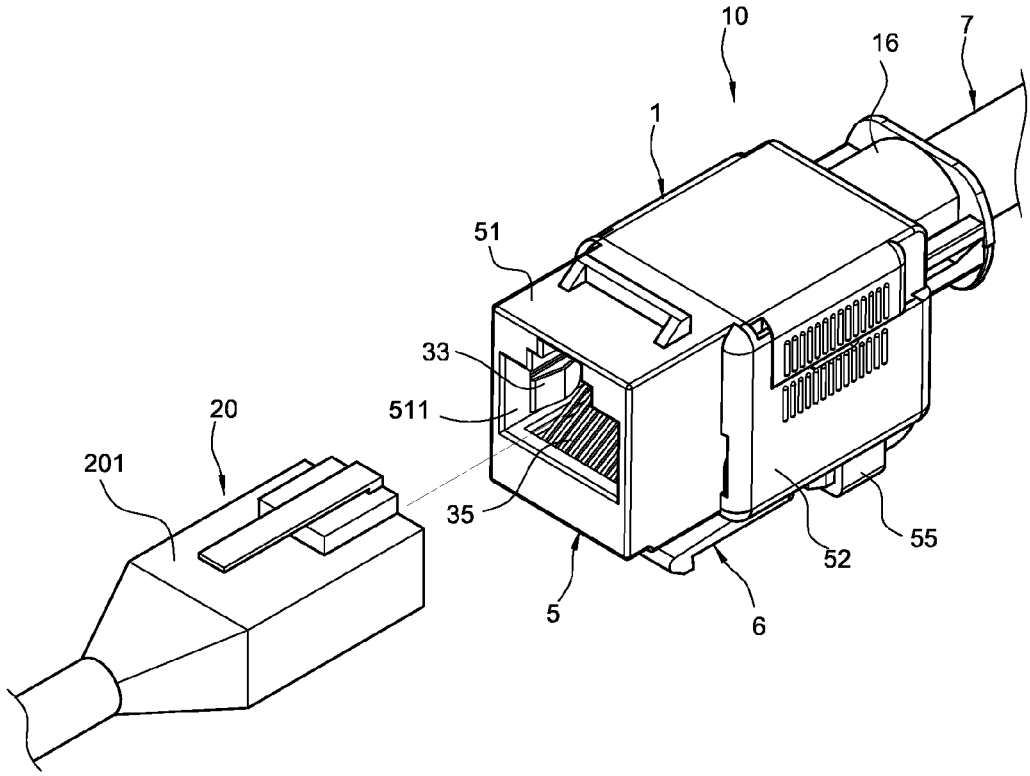
FIG. 9 shows a diagram of the keystone jack of the present invention, which is connected to a network line.

FIG. 3 shows a top view of the combination of the cover body, the lining body, and the cable line of the present invention. FIG. 9 shows a diagram of the keystone jack of the present invention, which is connected to a network line. As shown in the FIG. 3 and the FIG. 9, when the keystone jack 10 is used, a plug 201 of a network line 20 is inserted in the port 511 of the keystone jack 10, so that the plug 201 is electrically connected to the conducting pins 35. The electronic signals in the network are through the conducting pins 35, the printed circuit board 4, the puncturing terminal 34, and the core wires 71 of the cable line 7.

When the electronic signals are transmitted, the electromagnetic waves from the puncturing terminals 34 are isolated by the double-cross isolation structure with the elongated partition plate 13 of the cover body 1, the short partition plate 14 of the cover body 1, the stud 23 of the lining body 2, and the separation plate 24 of the lining body 2, so that the electricity is more stable, and the crosstalk interferences are decreasing, and the impedance is more stable, and the electronic signals are not decayed.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A keystone jack (10) including comprising:

a cover body (1) including a space (11) formed between two sidewalls (cc), the cover body (1) including a bottom surface (111), an elongated partition plate (13) formed on the bottom surface (111), the elongated partition plate (13) perpendicularly interlacing a short partition plate (14), the short partition plate (14) including a bottom part (141), extending a distance (15) from the bottom surface (111);

a lining body (2) installed in the space (11), the lining body (2) having two symmetrical edges (21), a connection part (22) formed between the two edges (21), the connection part having a stud (23), including a first channel (231), a separation plate (24) being arranged between the two edges (21), the separation plate (24) including a convex wall (241) including a second channel (242) opposite the first channel (231), an opening (25) formed between the separation plate (24) and the connection part (22);

wherein when the lining body (2) is installed in the space (11), the elongated partition plate (13) is accommodated in the first channel and the second channel and the short partition plate (14) is accommodated in the opening.

2. The keystone jack (10) in claim 1, further comprising a joining part (12) having a barb shape is provided on each of the four corners of the space (11).

3. The keystone jack (10) in claim 2, further comprising a first neck part (16) extended from a side of the cover body (1), the first neck part (16) including a groove (161), the groove (161) being used to connect a cable line.

4. The keystone jack (10) in claim 3, wherein the two edges (21) have a plurality of symmetric slots (211), each slot (211) having a lateral insertion port (212).

5. The keystone jack (10) in claim 4, wherein the separation plate (24) divides the space (11) into an upper space and a lower space after the cover body (1) is assembled with the lining body (2).

6. The keystone jack (10) in claim 5, wherein the cable line (7) has a plurality of core wires (71), after the core wires (71) are inserted through the upper space, the lower, and the opening (25), after the core wires are inserted through the upper space and the lower space, the wire ends being inserted in to the insertion parts of the slots.

7. The keystone jack (10) in claim 6, further including a carrier body including a first bearing part and a second bearing part, and a metal spring (33); wherein the first bearing part includes a plurality of puncturing terminals, one side of the puncturing terminals being inserted into the slots and the other side having welding parts that are being welded into corresponding holes of a printed circuit board; the second bearing part (32) including a plurality of conducting pins (35), one side of the conducting pin (35) being a pin part (351), thereby the plurality of puncturing terminals and the plurality of conducting pins are electrically connected.

8. The keystone jack (10) in claim 7, further including a housing (5) including a fore end part (51) and a rear end part (52), the fore end part (51) and the rear end part (52) having an assembling space (53), the fore end part (51) including a port (511) for receiving a contact portion of the conducting pins; the rear end part (52) including a joint part (54), a coupling part (55) located underneath the housing (5) for receiving a flap.

9. The keystone jack (10) in claim 8, wherein the flap includes a cover to be connected to the rear end part of the housing, one side of the cover (61) being a second neck part (62) opposite to a first neck part (16) of the cover body (1), the first neck part and the second neck part forming a cavity to receive the plurality of core wires; an axial part on one side of the cover being pivotally connected to a resilient body (64), the resilient body (64) inserted through the coupling part (55).

* * * * *